United States Patent [19]

Stampfli

[11] 4,122,664

[45] Oct. 31, 1978

[54] ELECTRONIC WATCH

[75] Inventor: Jean-Marcel Stampfli, Le Landeron, Switzerland

[73] Assignee: Ebauches Electroniques S.A., Switzerland

[21] Appl. No.: 775,746

[22] Filed: Mar. 9, 1977

[30] Foreign Application Priority Data

Mar. 25, 1976 [CH] Switzerland ..... 3719/76

[51] Int. Cl.[2] ..... G04B 37/12

[52] U.S. Cl. ..... 58/88 B; 58/53; 58/90 B

[58] Field of Search ..... 58/121 A, 88 R, 88 C, 58/88 B, 90 R, 90 B, 152 L, 53, 54, 55, 23 R

[56] References Cited

U.S. PATENT DOCUMENTS

| | | | |
|---|---|---|---|
| 3,633,356 | 1/1972 | Kitazima | 58/88 C |
| 3,838,568 | 10/1974 | Zurcher | 58/23 R |
| 3,945,193 | 3/1976 | Yasuda | 58/88 R |
| 3,975,899 | 8/1976 | Haber | 58/23 R |
| 4,043,115 | 8/1977 | Bryceland | 58/90 B |
| 4,043,638 | 8/1977 | Kaufmann | 58/127 R |

*Primary Examiner*—Robert K. Schaefer
*Assistant Examiner*—Lerner Pojunas, Jr.
*Attorney, Agent, or Firm*—Silverman, Cass & Singer

[57] ABSTRACT

An electronic watch with a body surrounded by a metallic ring. The ring is elastically deformable in at least some locations. Electrical contact blocks are positioned opposite the deformable portions of the ring. Pushers are operable on the ring to deform the same into contact with the blades to control functions thereof.

7 Claims, 6 Drawing Figures

ELECTRONIC WATCH

BACKGROUND OF THE INVENTION

The present invention relates to an electronic watch of the solid state type which does not comprise any movable mechanical element except for control elements which are manually operable for permitting control of the watch operations.

Electronic components or modules of watches are very sensible to humidity. It therefore is desirable to protect such components or modules in an efficient manner and independently from the watch protection ensured by the casing because the tightness of the watch casing is obtained only by means of expensive manufacture. This especially is true if the watch comprises, as is the case with most electronic watches, control devices which must be operable outside of the case. Such control devices can, for instance, operate to effect display of the time hour which is obtained by means of diodes. Such control devices may serve for correction of the date, in the case of calender-watches, or for the lighting of the display device in the case of watches with passive display device comprising liquid crystal cells.

SUMMARY OF THE INVENTION

The object of the present invention is to furnish means permitting on the one hand efficient protection of the electronic components of the watch independently from the properties of tightness of the casing, and on the other hand to reach easily the several electric contacts which must be put to ground in order to control the several functions of the watch.

Hence, the watch casing need not present a high degree of tightness and, consequently, may be constructed of inexpensive material or of materials permitting new effects of presentation.

The electronic watch according to the invention is characterized by the fact that the totality of the electronic components of the watch, included the display device or devices, are entirely surrounded with humidity resistant insulating material. The body thus produced is surrounded with a metallic ring, which is elastically deformable in at least some locations. The ring is maintained, on the greates portion of its height, at a distance from the said body. Contact blocks are located opposite the deformable portion of the ring. The blocks are carried by the said body are in electrical connection with some electronic components located within the said body. The said ring is connected to a ground in the watch in such a manner that, when a radially-directed force is exerted on the ring at a point opposite one or the other of the said blocks, the ring is deformed to bring it into contact with the said block to connect the block to ground and thus control a function of the watch.

BRIEF DESCRIPTION OF THE DRAWING

The drawing shows, by way of example, one embodiment constructed in accordance with the object of the invention, and a modification thereof.

DESCRIPTION OF THE PREFERRED EMBODIMENTS

Figure 1:
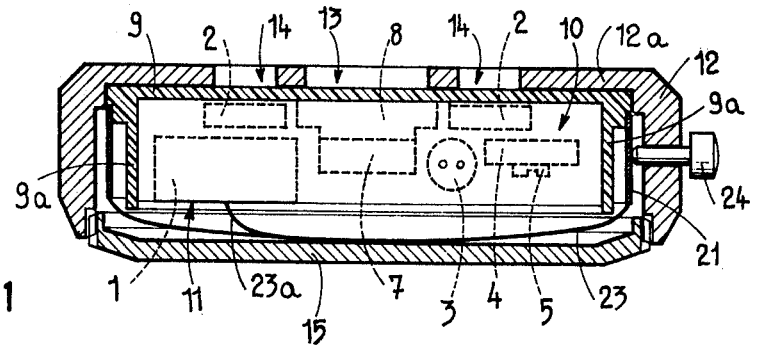
FIG. 1 is an axial sectional view of an electronic wrist-watch.

The electronic wrist-watch represented is of the solid state type, called "solid state", that is one which does not comprise any movable mechanical element, except for the control elements which are operable permit manual to control of the watch functions. The watch comprises a source of energy and an accumulator 1 and solar photo-sensible cells 2 for re-charging the accumulator 1. The watch also includes a quartz timekeeper 3, a capacity 4 provided with a screw 5 for adjusting the running of the watch, and a printed circuit 6. The watch display device 8, below which is positioned a diffuser 7, may be of the active or of the passive type.

All of the above mentioned components are located in a cap 9, constructed of insulating plastic material. The lateral wall **9*a* of cap 9, cylindrical. The cap is filled with a neutral gel 10 silicon, embedding all of the components and permitting only the rear face 11 of the accumulator 1** to show. As a result of this arrangement, the electronic components are entirely sheltered from any outer influence, especially from humidity.

It is to be noted that the gel 10 does not prevent access to the screw 5 to adjust running of the watch; the consistency of the gel is such to permit the screw to be engaged by a screwdriver. If the watch includes an accumulator 1 which is not associated with a re-chargeable battery, a compartment would be provided in the gel 10 to enable replacement of the battery without jeopardizing the tightness of the cap.

The cap 9 is located in a casing including a cap 12 the upper face **12*a* of which is provided with a window 13 disposed opposite the display device 8, and with windows 14 disposed opposite the photo-sensitive cells 2. The casing is provided with a screwed bottom 15**.

Figure 2:
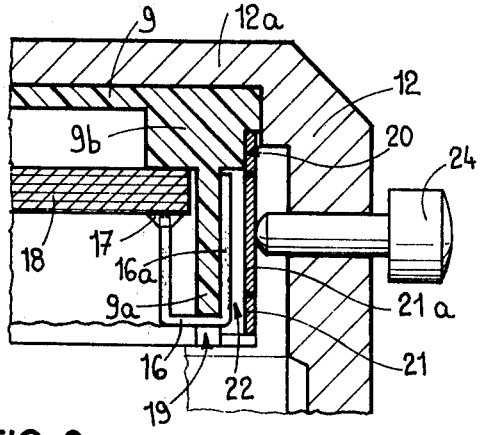
FIG. 2 is a sectional view of a detail of said watch taken on an enlarged scale.
Figure 3:
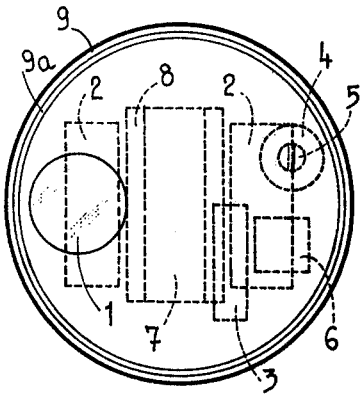
FIG. 3 is a top plan view of a portion of said watch at the scale of FIG. 1.
Figure 4:
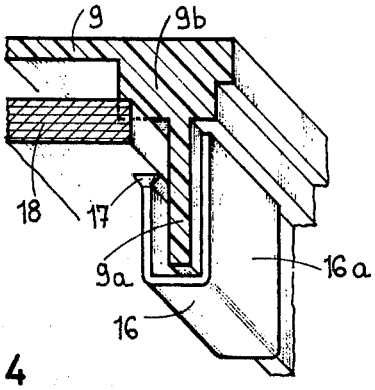
FIG. 4 is a perspective view of a detail of said watch.
Figure 5:
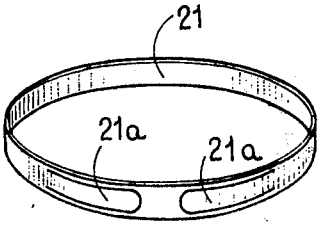
FIG. 5 is a perspective view of another detail of said watch taken on a smaller scale.

For purposes of enabling control of the several functions of the watch, electrical conductors 16, only one of which has been shown, formed of metallic straps (FIG. 4), are embedded in the gel 10 and connected to the electrical components. The conductor 16 is shown in FIG. 2 welded at 17 on a ceramic substrate or on a printed circuit 18.

The conductors 16 pass over the top of the lateral wall **9*a* of the cap 9, in recesses 19 provided in the edge thereof, and terminate at 16*a* along the outer face of the said wall 9*a***.

An annular should **9*b* is provided on cap 9 and is disposed substantially at the level of the undersurface of the cap in a groove 20. A metallic cylindrical ring is engaged in groove 20 by one of its ends 21. An annular free space 22 is provided between the ring 21 and the lateral wall 9*a* of the cap 9. The metallic ring 21 is maintained in contact with the mass of the watch, that is to say with the rear face 11 of the accumulator 1, by a spring 23 constituted by a cambered metallic washer. The spring 23 bears on the one hand on the bottom 15 of the casing and on the other hand on the edge of the ring 21, thereby serving as a mounting ring for maintaining the cap 9 in place in the casing; the spring also provides the electric contact with the rear face 11 of the accumulator 1, by means of an elastic tongue 23*a***.

The cylindrical ring 21 is provided with elastically deformable tongues **21*a*, formed by cuts in the ring. In the embodiment shown, the tongues are two in number, corresponding to two control pushers, such as the pusher 24, mounted so as to be able to slide radially in the body of the casing 12; number of tongues could be different. Each of the pushers 24 is situated opposite one of the ends of the tongues 21***a*, which are themselves each positioned opposite a conductor 16*a*.

As a modification, and if the ring is sufficiently resilient and deformable, it will not be necessary to cut tongues therein.

The arrangement is such that, when a force is exerted on one of the pushers 24, the corresponding tongue 21*a* of the ring 21 is resiliently deformed inwardly until it comes in contact with the corresponding conductor 16*a*, which is thereby engaged to ground, to control one function of the watch.

The tongues 21*a* operate also as return-springs for the pushers. These pushers can be made of metal or of plastic material as the casing of the watch itself.

The present construction presents not only the advantages mentioned previously, but also that of permitting more precise of the ground contact than is the case in usual constructions where the connection to ground is often badly defined.

Figure 6:
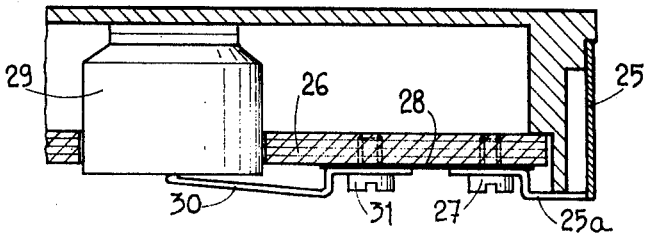
FIG. 6 is a sectional view of a detail of a modification of said watch.

The modification of FIG. 6 is used in instances where the casing is made entirely of plastic material so as not to permit connection of the contact ring to the accumulator by means of a spring as spring 23 such of the first embodiment.

In the modification, the contact ring 25 is provided with a tongue 25*a*, bent inwardly and secured to the substrate or circuit 26 by a screw 27. The end of the tongue 25*a* is applied against a conductive track 28 deposited on the substrate 26. The electric battery 29 is maintained in place by a blade 30 secured to the substrate 26 by a screw 31, the end of this blade 30 being also applied on the conductive track 28.

The remainder of the device of FIG. 6 comprises conductors identical to the conductors 16–16*a* of the first embodiment, not represented in FIG. 6.

What I claim is:

1. An electronic watch of the solid state type with no movable mechanical elements excepting the control elements which are manually operable to control the functions of the watch, said watch comprising, a body retaining all of the electrical components of the watch including the display devices thereof, said electrical components being completely surrounded with insulating material to render the watch humidity resistant, a metallic ring surrounding said body, said ring being elastically deformable at least at some locations thereon, said ring being maintained on the greatest portion of its height at a distance from said body, electrical contact blocks connected with electrical components within the body, said blocks being carried by the body at a location opposite the deformable portions of the ring, the ring being connected to ground of the watch, whereby exertion of a radial force on the ring at a location opposite one or the other of said blocks will deform the ring to cause the same to contact a block and ground the ring to control a function of the watch.

2. An electronic watch as claimed in claim 1 including a support in the shape of a cap constructed of insulating materials, said electrical components being disposed within said support, and an electrically insulating gel molded within the cap completely embedding said electrical components.

3. An electronic watch as claimed in claim 2 in which the cap has an outer lateral face of generally cylindrical configuration, the base of the cap having a shoulder, said contact ring being of generally cylindrical configuration and engaged on said shoulder, there being an annular free space between the outer lateral face of the cap and the inner face of the ring.

4. An electronic watch as claimed in claim 3 including a casing, pushers carried by the casing and positioned opposite selected points of said ring, said cap being positioned in the casing, said pushers being positioned opposite the contact blocks, whereby exertion of a force against a pusher causes the ring to deform and make contact with a block.

5. An electronic watch as claimed in claim 4 in which the ring includes tongues cut therefrom, said tongues being elastically deformable upon exertion of a force thereagainst.

6. An electronic watch as claimed in claim 4 in which said ring acts as a return spring for the pushers.

7. An electronic watch as claimed in claim 1 in which said ring acts as a mounting ring.

* * * * *